US005389854A

United States Patent [19]

True

[11] Patent Number: 5,389,854

[45] Date of Patent: Feb. 14, 1995

[54] COLLECTOR ION EXPELLER

[75] Inventor: Richard B. True, Sunnyvale, Calif.

[73] Assignee: Litton Systems, Inc., Beverly Hills, Calif.

[21] Appl. No.: 917,815

[22] Filed: Jul. 21, 1992

[51] Int. Cl.[6] ..... H01J 23/027

[52] U.S. Cl. ..... 315/5.38; 313/36

[58] Field of Search ..... 315/5.38; 313/35, 36, 313/22

[56] References Cited

U.S. PATENT DOCUMENTS

| | | | |
|---|---|---|---|
| 3,368,104 | 2/1968 | McCullough | 315/5.38 |
| 3,626,230 | 12/1971 | Stewart | 315/5.38 X |
| 3,824,425 | 7/1974 | Rawls, Jr. | 315/5.38 X |
| 4,096,409 | 6/1978 | Hechtel | 315/5.38 |
| 4,794,303 | 12/1988 | Hechtel et al. | 315/5.38 |

FOREIGN PATENT DOCUMENTS

| | | | |
|---|---|---|---|
| 258667 | 3/1988 | European Pat. Off. | 315/5.38 |
| 109234 | 4/1990 | Japan | 315/5.38 |
| 79128 | 3/1992 | Japan | 315/5.38 |

*Primary Examiner*—Benny T. Lee

*Attorney, Agent, or Firm*—Graham & James

[57] ABSTRACT

An electron collector is provided for collecting spent electrons generated by a cathode of an electron gun after passage through an interaction region of a microwave device. The collector comprises a bucket having internal walls which define an enclosed region having an entrance aperture through which electrons pass after exiting the microwave device. An electrode is disposed proximate the entrance aperture within the enclosed region. A positive potential is applied to the electrode with respect to the microwave device. The potential forms a substantially ion-free region at the entrance aperture which promotes the efficient dispersal of the spent electrons due to space charge.

20 Claims, 4 Drawing Sheets

FIG. 6
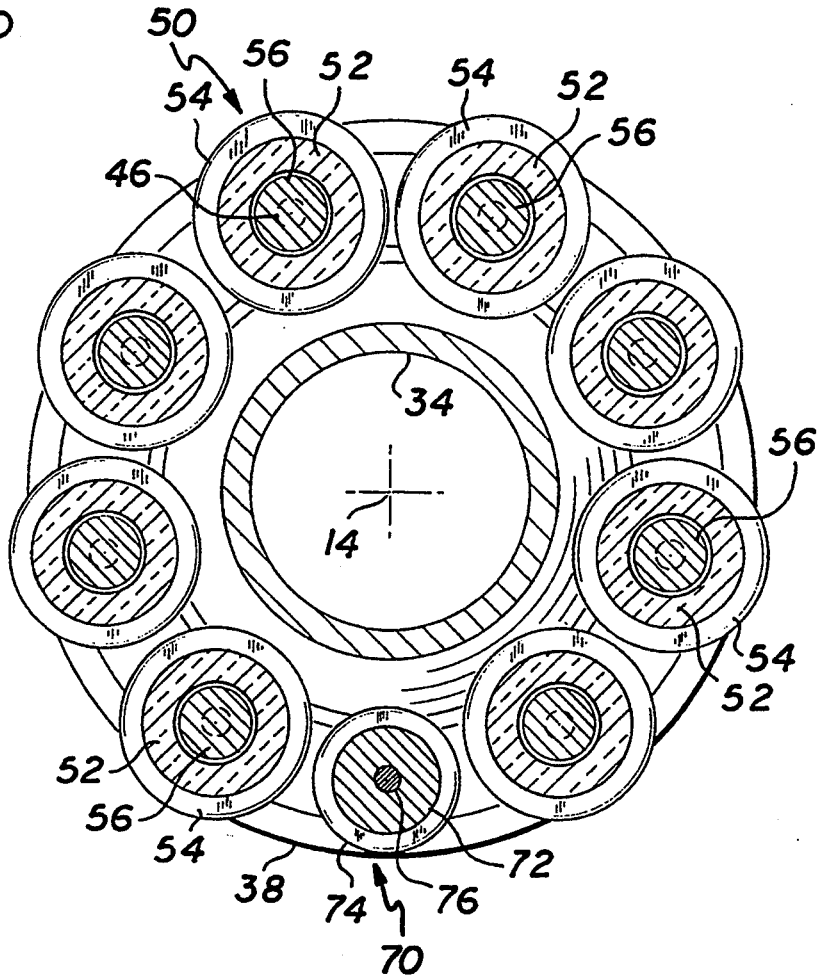
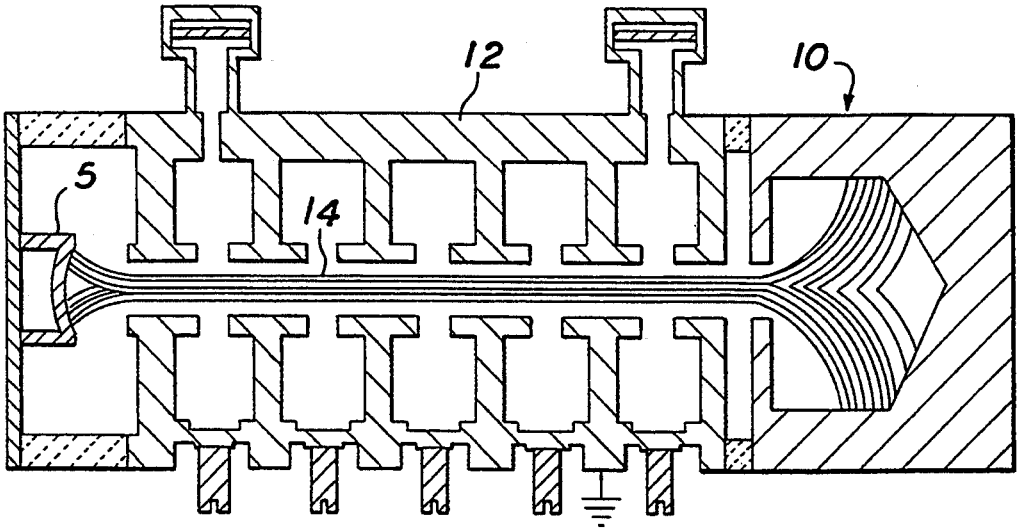
FIG. 7

COLLECTOR ION EXPELLER

BACKGROUND OF THE INVENTION

1. Field of the Invention

The present invention relates to an improved electron beam collector and, more particularly, to a collector having an ion expeller to repel ion build up within the collector and promote efficient electron dispersal.

2. Description of Related Art

Many electronic devices employ a travelling stream of charged particles, such as electrons, formed into a beam as an essential function in the device's operation. In a linear beam device, an electron beam originating from an electron gun is caused to propagate through a tunnel, or drift tube, generally containing an RF interaction structure. Within the interaction structure, the beam must be focused by magnetic or electrostatic fields in order for it to be effectively transported through the interaction structure without energy loss. In the interaction structure, kinetic energy is transferred from the moving electrons of the beam to an electromagnetic wave that is propagating through the interaction region at approximately the same velocity as the moving electrons. The electrons give up energy to the electromagnetic wave through an exchange process characterized as electronic interaction, which is evident by a reduced velocity of the electron beam from the interaction region. These "spent" electrons pass out of the interaction region where they are incident upon and collected by a final element, termed the collector. The collector collects and returns the incident electrons to the voltage source. Much of the remaining energy in the charged particles is released in the form of heat when the particles strike a stationary element, such as the walls of the collector.

After the beam enters the collector, the absence of magnetic focusing causes the individual electrons to disperse due to space charge. Since the electrons have like charges, they naturally repel from each other. The dispersed electrons evenly strike the internal walls of the collector. Typically, heat generated by the impacting electrons is conducted through the collector walls to an external coolant jacket which surrounds the collector.

Collector operation can be significantly degraded if the beam fails to disperse evenly within the collector. Electron impact within the collector often produces positive ions which can build up within the collector and cancel the space charge. The absence of space charge within the collector can cause the electrons to remain focused in the beam. If the concentrated beam were to strike a single spot within the collector, rather than being dispersed, the beam could quickly overstress or damage the collector. High power beams which operate at near relativistic velocities tend to develop a self induced magnetic field which also contributes to keeping the beam focused after entering the collector.

Thus, it would be desirable to provide an electron beam collector capable of expelling the ions which build up within the collector and prevent efficient electron beam dispersal.

SUMMARY OF THE INVENTION

Accordingly, an object to the present invention is to provide an electron beam collector which expels ions at the entrance of the collector to allow efficient electron beam dispersal.

To achieve this object and in accordance with the purpose of the invention, an electron collector is provided for collecting spent electrons generated by a cathode of an electron gun after passage through an interaction region of a microwave device. A collector comprises a bucket having internal walls which define an enclosed region having an entrance aperture through which the electrons pass after exiting the microwave device. An electrode is disposed proximate the entrance aperture within the enclosed region. A positive potential is applied to the electrode with respect to the microwave device. The potential forms a substantially ion free region at the entrance aperture which promotes the dispersal of the spent electrons due to space charge. The electrode is substantially funnel shaped and is secured to the enclosed region by a plurality of thermally conductive, electrically insulative support posts. An electrical connection is formed between the electrode and an external voltage source through an electrical feedthrough.

A more complete understanding of the collector ion expeller of the present invention will be afforded to those skilled in the art as well as a realization of additional advantages and objects thereof by a consideration of the following Detailed Description of the Preferred Exemplary Embodiment. Reference will be made to the appended sheets of drawings which will be first described briefly.

BRIEF DESCRIPTION OF THE DRAWINGS

FIG. 6 shows a sectional view of the collector ion expeller electrode as taken through the section 6—6 of FIG. 5; and FIG. 7 shows a the collector used in conjunction with an electron gun and interaction structure.

DESCRIPTION OF THE PREFERRED EMBODIMENTS

Figure 1:
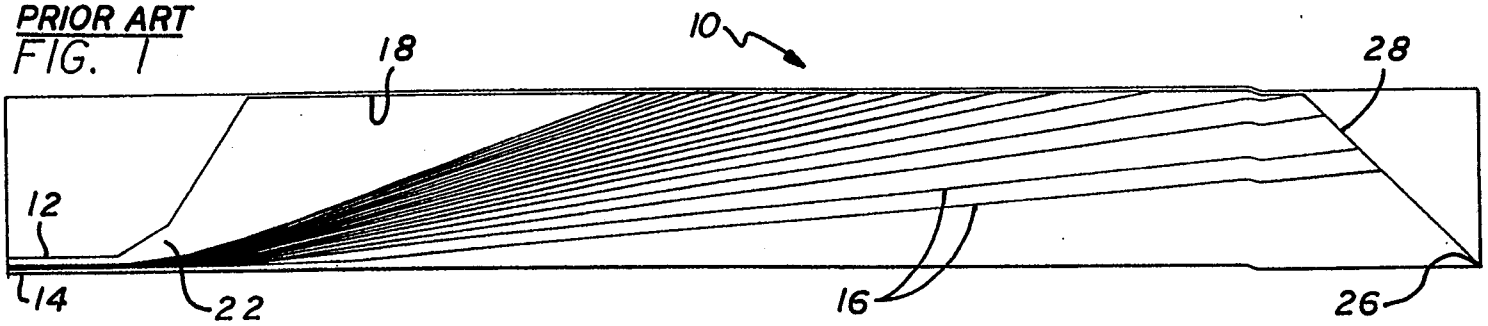
PRIOR ART FIG. 1
FIG. 1 shows a computer model of an electron beam dispersing due to space charge within a typical prior art collector.
Figure 2:
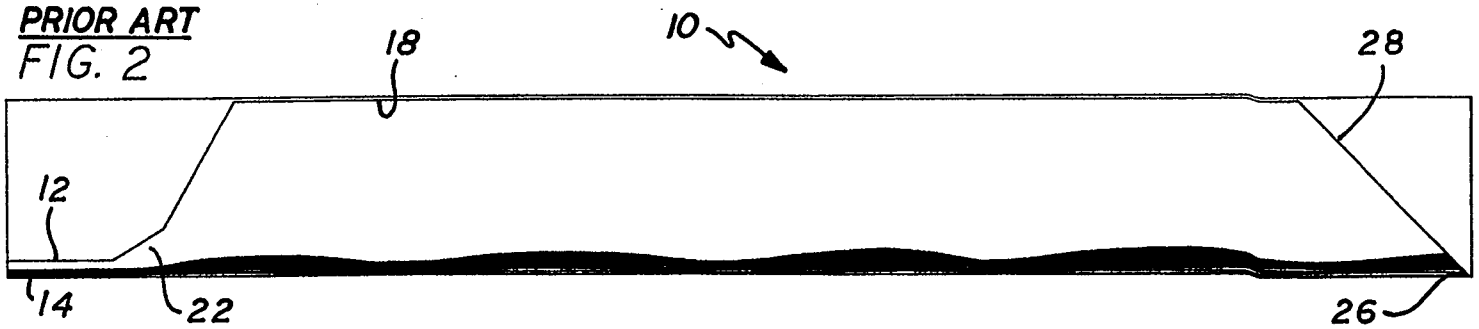
PRIOR ART FIG. 2
FIG. 2 shows a computer model of an electron beam as in FIG. 1, with the beam generally collapsed due to ion build up within the prior art collector.
Figure 3:
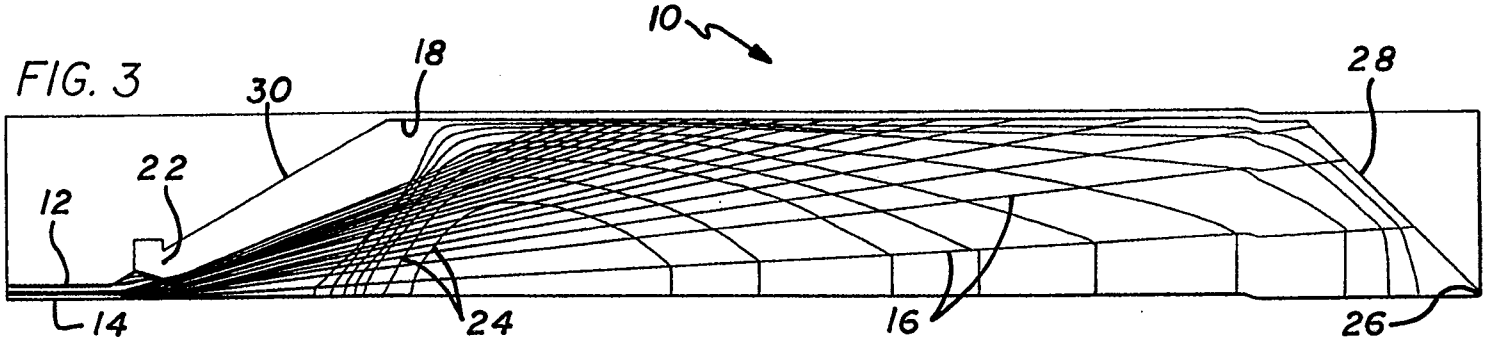
FIG. 3 shows a computer model of an electron beam as in FIG. 1, with the beam dispersing within a collector in reaction to an ion expeller electrode disposed at an entrance aperture of the collector in accordance with the teachings of the present invention.

Referring first to FIGS. 1, 2 and 3, there is shown various computer models simulating electronic flow within a collector. The bottom boundary of each of the views represent the center line of a typical collector 10. At the left hand side of the figures, a microwave tube body 12 is provided which joins to a collector entrance aperture 22. The collector 10 has internal collector walls 18 represented by the upper boundaries of the figure, as well as a collector conical section 28, represented by the downward sloping boundary at the right portion of the figures, and a collector back end 26. As known in the art, a typical collector 10 has an internal chamber to receive and dissipate the electronic flow exiting the microwave tube body 12.

FIG. 1 shows a typical collector 10 receiving a focused beam 14 from a microwave tube body 12. After entering through the collector entrance aperture 22, the beam immediately begins to diverge due to the absence of magnetic focusing and the space charge within the collector 10. Individual electrons 16 can be seen striking the internal collector walls 18 and the collector conical section 28 in a generally evenly spaced pattern. FIG. 1 represents near ideal conditions within the collector 10, such that the electron beam is efficiently dispersed and dissipated.

In contrast, FIG. 2 represents the worst case scenario for the collector 10. Rather than diverging as in FIG. 1, the electron-beam 14 remains focused the entire length of the collector, and ultimately impinges upon the collector back end 26. Unlike the earlier described figure, the electron beam 14 failed to diverge due to positive ion build up within the collector. The ion build up neutralizes the space charge, and keeps the beam 14 in a focused state. The beam concentration at the collector back end 26 would cause the collector portion to heat up and ultimately damage the collector 10.

The conditions of FIG. 2 are effectively eliminated by the introduction of a net positive potential adjacent the collector entrance aperture 22, as shown in FIG. 3. An electrode having a field potential of +75 kilovolts relative to the microwave tube is simulated by the surface 30 of FIG. 3. Equipotential lines 24 are drawn within the collector 10 to show the diminishing field level as the distance from the electrode surface 30 increases. The potential provided on the electrode surface 30 forces any ions within the collector 10 to withdraw to the back end of the collector 10. This allows the electrons 16 of the electron beam 14 to efficiently disperse, as would occur in the absence of ions. Despite the concentration of ions at the back end of the collector 10, the beam 14 does not become refocused since it has already become substantially dispersed.

Figure 4:
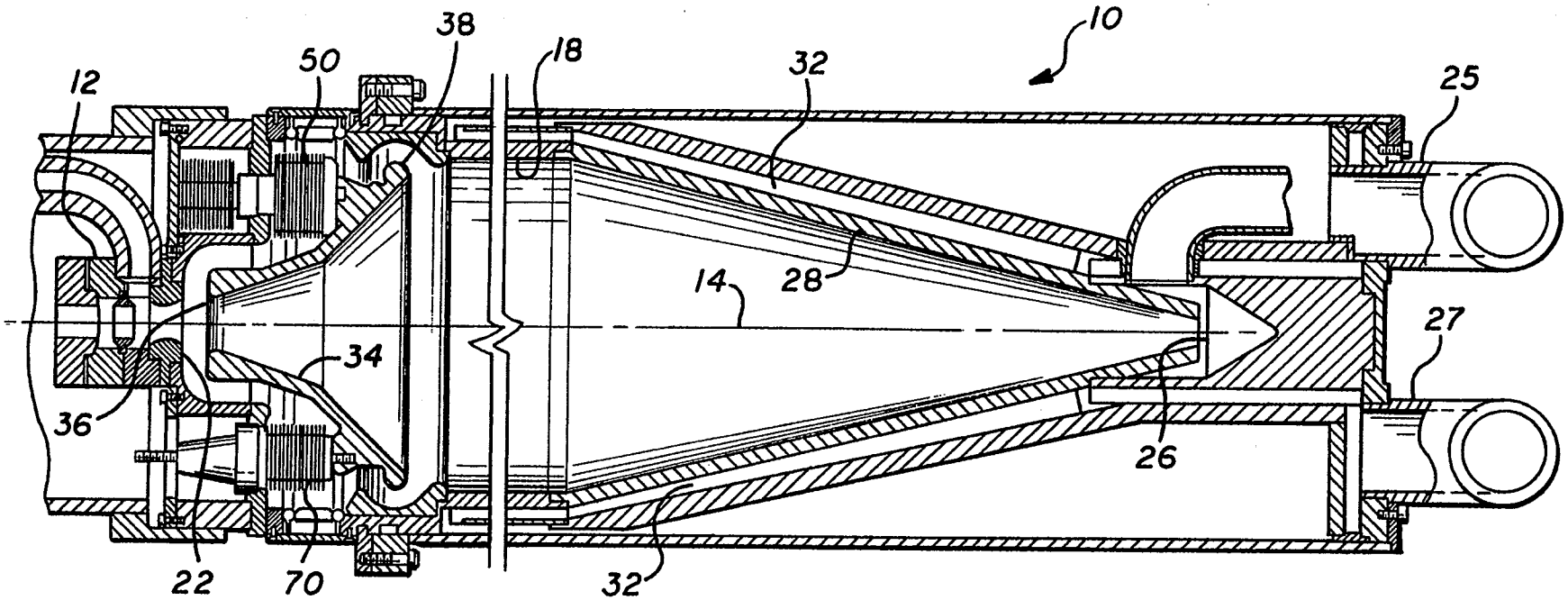
FIG. 4 shows a cross-sectional view of the collector having the inventive ion expeller electrode.
Figure 5:
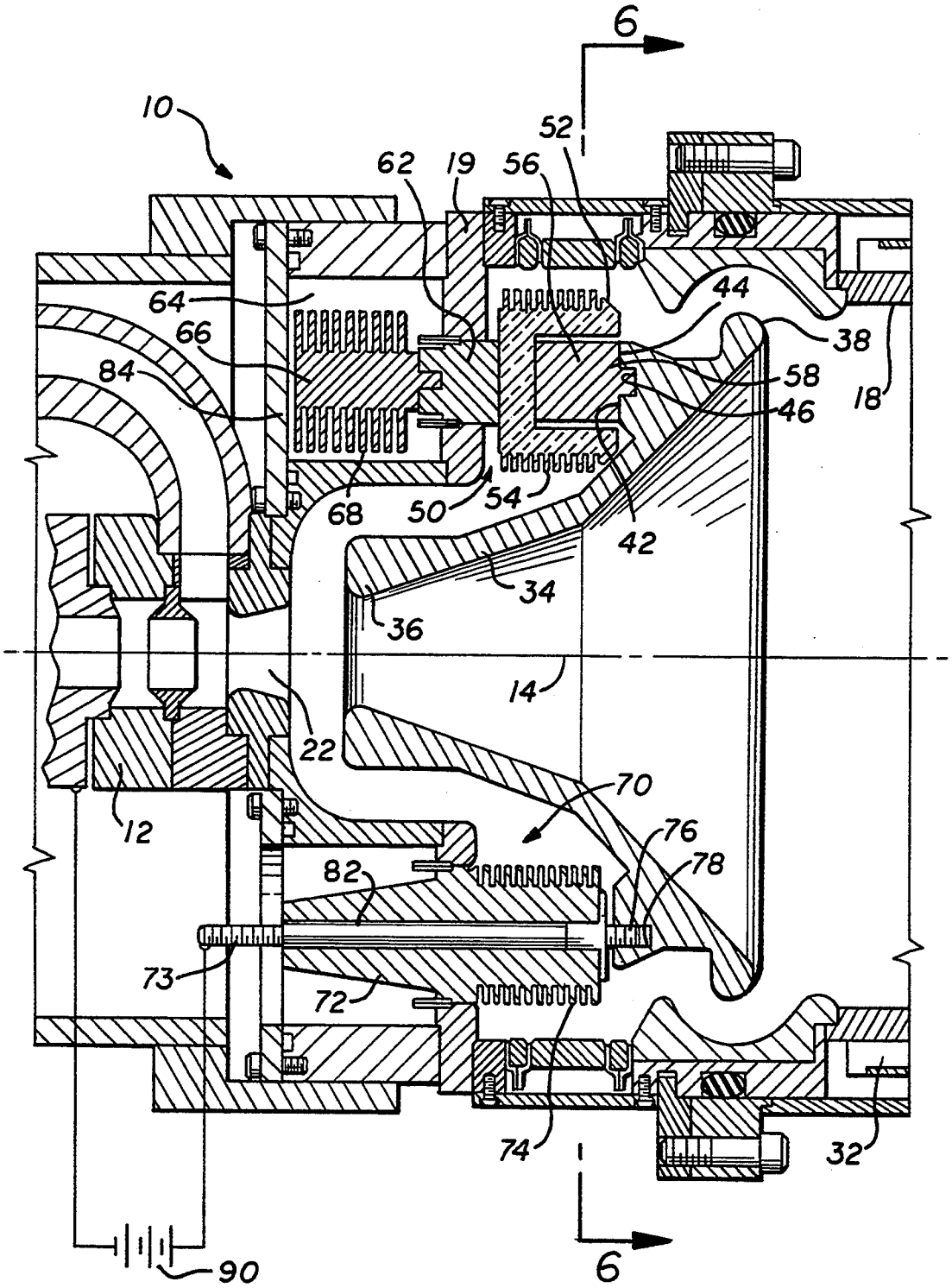
FIG. 5 shows a cross-sectional view of the collector ion expeller electrode as in FIG. 4 in greater detail.

Referring now to FIGS. 4, 5 and 6 a typical collector 10 is shown. The collector 10 has an entrance aperture 22 which receives the expended electron beam 14 from the microwave tube body 12. The collector 10 further has generally cylindrical walls 18 which transition to a conically shaped section 28. At the far end of the collector 10, the conical section 28 terminates at an end portion 26. The walls 18 and conical section 28 are generally formed from a highly thermally conductive material, such as copper. Surrounding the walls 18 and conical section 28, is a coolant jacket 32. The jacket 32 conducts a flow of a coolant liquid to channel heat absorbed through the walls 18 and the conical section 28. Coolant inlet pipe 25 and outlet pipe 27 are provided to conduct the coolant fluid to and from a coolant reservoir (not shown).

The electrode 34 is generally funnel shaped, and is disposed within the collector 10 adjacent to the collector entrance aperture 22. The electrode 34 has a leading edge 36 (see FIGS. 4, 5) adjacent to the aperture 22, and a trailing end 38 (see FIGS. 4, 5) adjacent to the outer walls 18. The electrode 34 is generally formed of a thermally and electrically conductive material, such as copper.

As illustrated in FIGS. 5, 6, the electrode 34 is suspended in place within the collector 10 by a plurality of thermally conductive, electrically insulative support posts, shown generally at 50. The support posts 50 include a coupling member 56 which joins to the electrode 34, a ceramic insulator 52 surrounding the coupler 56, and a coupler 62 which extends through forward support walls 19 of the collector 10. The coupler 56 has a mounting surface 44 with a peg tenon 58 extending axially from the mounting surface. The electrode 34 has a corresponding mounting surface 42 and a corresponding mortise 46 which receives the peg tenon 58. The coupler 56 and the electrode 34 are integrally formed together to rigidly hold the electrode in place and conduct heat from the electrode to a point external to the collector 10.

The insulator 52 is generally cup shaped and surrounds the coupler 56 to prevent heat from being exchanged back into the collector 10. As known in the art, the insulator 52 has a plurality of radiator fins 54 to further enhance its insulative capabilities. It is anticipated that the insulator 52 be formed from a beryllium oxide ceramic material.

Axially linked to the insulator 52 is the coupling member 62. The coupling member 62 extends through the support walls 19 and rigidly secures the electrode 34 to the walls. The coupler 62 provides both rigid support for the post 50 and provides a thermal path to an annular coolant channel 64. A heat radiator 66 joins to the coupler 62 for the purpose of depositing heat drawn from the electrode 34 into the coolant channel 64. The heat radiator 66 has a plurality of fins 68, as known in the art.

To provide the voltage potential to the electrode 34, a single electrical feedthrough is provided, shown generally at 70. The electrical feedthrough 70 comprises a ceramic insulator 72 having a central bore 82 (see FIG. 5) which surrounds a high voltage lead 73. The lead 73 has a conduction terminal 76 which electrically joins to a corresponding receptacle 78 provided in the electrode 34. An end of the lead 73 extends through the outer cover plate 84, shown in phantom. Once the lead 73 is external to the collector 10, the lead can be joined to a voltage source 90. The ceramic insulator 72 has a plurality of insulator fins 74 to further enhance its insulative capabilities. It is anticipated that the insulator 72 be formed from an alumina oxide ceramic material.

In the preferred embodiment, there are eight support posts 50 and one electrical feedthrough 70. The placement of the posts and the feedthrough is shown in FIG. 6. The posts 50 are evenly spaced coaxially with the collector 10, with a space left for the single feedthrough 70. Since the feedthrough 70 is generally smaller than the posts 50, the spacing may not be completely symmetrical. It should be apparent that alternative spacing configurations are also possible to achieve a similar result. Note that the view of FIG. 5 shows a post 50 and a feedthrough 70 evenly divided in half. As should be apparent from FIG. 6, the view would not be entirely to scale, since the feedthrough 70 is not disposed 180° opposite the post 50.

To operate the collector 10 with the electrode 34, an electric potential is applied to the electrode through the lead 73. It is anticipated that a potential of up to +100 kilovolts relative the microwave tube 12 be applied to the electrode 34. The potential would form a saddle shaped field region within the collector 10 adjacent to the entrance aperture 22. This region would force ions to the back end of the collector 10 and produce a substantially ion free region at the front end of the collector. The electron beam 14 would then rapidly disperse once it passes the concentrated field formed by the electrode 34. The dispersed electrons 16 would strike the inner walls 18 and the conical section 28, and dissipate in the form of heat which is removed from the collector 10 via the coolant channels 32. Since a portion of the electrons from the beam 14 may impinge upon the electrode 34, the path to the coolant channel 64 is provided through couplers 56 and 62 to remove the excess heat from the electrode 34.

In FIG. 7, the collector 10 is shown secured to a microwave tube body 12. The tube body 12 has an internal interaction structure in which the electron beam 14 interacts with a travelling microwave RF signal. An electron gun 5 is provided at an opposite end of the tube body 12, and provides the electron beam 14. Note that the electron beam 14 remains focused throughout the interaction structure, and dissipates rapidly upon entering the collector 10.

Having thus described a preferred embodiment of a collector ion expeller, it should now be apparent to the those skilled in the art that the aforestated objects and advantages for the within system have been achieved. It should also be appreciated by those skilled in the art that various modifications, adaptations and alternative embodiments thereof may be made within the scope and spirit of the present invention. For example, alternative shapes and materials for the expeller electrode 34 could be advantageously utilized, or other expeller voltages including AC.

The present invention is further defined by the following claims:

What is claimed is:

1. In a microwave device having an electron gun, an interaction structure, and an electron collector operatively connected together, said collector collecting spent electrons generated by said electron gun and after passage of the electrons through said interaction structure, said collector comprising:

an electrically and thermally conductive bucket having internal walls which define an enclose region having an entrance aperture through which said spent electrons pass after exiting said interaction structure;

an electrode suspended from said internal walls within said enclosed region adjacent said entrance aperture, said electrode being electrically insulated from said internal walls; and means for applying a potential connected to said electrode, said potential being positive with respect to said interaction structure, said potential repelling ions within said collector to produce an ion-free region adjacent said entrance aperture thereby promoting dispersal of said spent electrons within said collector.

2. The electron collector of claim 1, wherein said electrode is substantially funnel-shaped.

3. The electron collector of claim 1, further comprising a plurality of thermally conductive, electrically insulative support posts disposed within said enclosed region which physically secure said electrode to said internal walls.

4. The electron collector of claim 1, wherein said applying means further comprises an electrical conduction path provided within an electrical feedthrough extending through said internal walls for electrically connecting said electrode to an external voltage source.

5. In a microwave device having an electron gun, an interaction structure, and an electron collector Operatively connected together, said collector collecting spent electrons generated by said electron gun and after passage of the electrons through said interaction structure, said collector comprising:

an electrically and thermally conductive bucket having internal walls which define an enclosed region having an entrance aperture through which said spent electrons pass after exiting said interaction structure;

an electrode suspended from said internal walls within said enclosed region adjacent said entrance aperture; and means for applying a potential connected to said electrode, said potential being positive with respect to said interaction structure, said potential repelling ions within said collector to produce an ion-free region adjacent said entrance aperture thereby promoting dispersal of said spent electrons within said collector, wherein said applying means further comprises an electrical conduction path provided within an electrical feedthrough extending through said internal walls for electrically connecting said electrode to an external voltage source, wherein said potential is approximately +100 kilovolts.

6. A charged particle collector for collecting charged particles, comprising:

an enclosed region having an entrance for passing said charged particles;

an electrode suspended within said enclosed region adjacent to said entrance, said electrode being electrically insulated from said entrance; and means for applying a potential connected to said electrode, said potential being positive with respect to said entrance, wherein said potential repels ions of said charged particles to produce an ion-free region within said collector adjacent to said entrance.

7. The charged particle collector of claim 6, wherein said ion-free region adjacent said entrance promotes dispersal of said charged particles.

8. The charged particle collector of claim 7, wherein the charged particles are electrons.

9. The charged particle collector of claim 6, wherein said electrode is substantially funnel-shaped and is physically secured within said enclosed region by a plurality of thermally conductive, electrically insulative posts.

10. The charged particle collector of claim 6, wherein said applying means further comprises an electrical conduction path provided within an electrical feedthrough extending from a location external to said enclosed region into said enclosed region for electrically connecting said electrode to an external voltage source.

11. A charged particle collector for collecting charged particles, comprising:

an enclosed region having an entrance for passing said charged particles;

a single electrode suspended within said enclosed region adjacent to said entrance; and means for applying a potential connected to said electrode, said potential being positive with respect to said entrance;

wherein said potential repels ions of said charged particles to produce an ion-free region within said collector adjacent said entrance for promoting dispersal of said charged particles, said charged particles comprising electrons, said electrode being substantially funnel-shaped and physically secured within said enclosed region by a plurality of thermally conductive, electrically insulative posts, said applying means further comprising an electrical conduction path provided within an electrical feedthrough extending from a location external to said enclosed region into said enclosed region for electrically connecting said electrode to an external voltage source and said potential is approximately +100 kilovolts.

12. An electron collector coupled to a microwave device having an electron gun and an interaction structure operatively connected together, the collector collecting spent electrons generated by said electron gun and after passage of the electrons through said interaction structure, comprising:

an electrically and thermally conductive bucket having internal walls which define an enclosed region having an entrance aperture through which said electrons pass after exiting said interaction structure, the collector having a longitudinal axis coaxial with said entrance aperture;

an electrode suspended within said enclosed region, said electrode having an aperture coaxial with said longitudinal axis, said electrode being electrically insulated from said internal walls; and means for applying a potential connected to said electrode, said potential being positive with respect to said interaction structure, said potential generating an ion-free region adjacent to said entrance aperture thereby promoting dispersal of said spent electrons into directions divergent from said longitudinal axis.

13. The electron collector of claim 12, wherein said electrode is substantially funnel-shaped.

14. The electron collector of claim 12, further comprising a plurality of thermally conductive, electrically insulative support posts disposed within said enclosed region which physically secure said electrode to said internal walls.

15. The electron collector of claim 14, wherein there are eight of said support posts.

16. The electron collector of claim 14, wherein said support posts are comprised of a ceramic compound.

17. The electron collector of claim 16, wherein said posts are comprised of beryllium ceramic.

18. The electron collector of claim 12, further comprising an electrical conduction path provided within a feedthrough extending through said internal walls for electrically connecting said electrode to an external voltage source.

19. The electron collector of claim 18, wherein said feedthrough is comprised of alumina ceramic.

20. An electron collector coupled to a microwave device having an electron gun and an interaction structure operatively connected together, the collector collecting spent electrons generated by said electron gun and after passage of said electrons through said interaction structure, comprising:

an electrically and thermally conductive bucket having internal walls which define an enclosed region having an entrance aperture through which said electrons pass after exiting said interaction structure, the collector having a longitudinal axis coaxial with said entrance aperture;

an electrode suspended within said enclosed region, said electrode having an aperture coaxial with said longitudinal axis; and means for applying a potential connected to said electrode, said potential being positive with respect to said interaction structure, said potential generating an ion-free region adjacent said entrance aperture thereby promoting dispersal of said spent electrons into directions divergent from said longitudinal axis, wherein said potential is approximately +100 kilovolts.

* * * * *